US011033774B1

(12) United States Patent
Clarke

(10) Patent No.: US 11,033,774 B1
(45) Date of Patent: Jun. 15, 2021

(54) EXERCISE BAND BAR

(71) Applicant: Gerald M. Clarke, Lake Leelanau, MI (US)

(72) Inventor: Gerald M. Clarke, Lake Leelanau, MI (US)

( * ) Notice: Subject to any disclaimer, the term of this patent is extended or adjusted under 35 U.S.C. 154(b) by 0 days.

(21) Appl. No.: 17/149,879

(22) Filed: Jan. 15, 2021

Related U.S. Application Data

(60) Provisional application No. 62/965,223, filed on Jan. 24, 2020.

(51) Int. Cl.
*A63B 21/00* (2006.01)
*A63B 21/055* (2006.01)
*A63B 21/04* (2006.01)

(52) U.S. Cl.
CPC .... *A63B 21/4035* (2015.10); *A63B 21/00185* (2013.01); *A63B 21/0555* (2013.01); *A63B 21/0557* (2013.01); *A63B 21/0414* (2013.01); *A63B 21/0428* (2013.01)

(58) Field of Classification Search
CPC ..... A63B 21/0004; A63B 21/00043; A63B 21/00058; A63B 21/00065; A63B 21/00069; A63B 21/00072; A63B 21/00076; A63B 21/00178; A63B 21/00181; A63B 21/00185; A63B 21/002; A63B 21/0023; A63B 21/02; A63B 21/04; A63B 21/0407; A63B 21/0414; A63B 21/0421; A63B 21/0428; A63B 21/0435; A63B 21/0442; A63B 21/055; A63B 21/0552; A63B 21/0555; A63B 21/0557; A63B 21/068; A63B 21/072; A63B 21/0722; A63B 21/0724; A63B 21/0726; A63B 21/0728; A63B 21/015; A63B 21/151; A63B 21/153; A63B 21/4027; A63B 21/4033; A63B 21/4035; A63B 21/4043; A63B 10/00; A63B 10/50; A63B 10/52; A63B 2225/09
See application file for complete search history.

(56) References Cited

U.S. PATENT DOCUMENTS 1,749,544 A * 3/1930 Pagano ..... A63B 21/00043 482/126
1,815,863 A 7/1931 Noe
2,396,106 A * 3/1946 Kussnir ..... A63B 21/027 482/109
3,785,645 A * 1/1974 Yosef ..... A63B 21/169 482/126
4,059,265 A 11/1977 Wieder et al.
4,195,835 A 4/1980 Hinds et al.
(Continued)

OTHER PUBLICATIONS

Anazao Fitness Gear, Anazao Fitness Gear 40" (Advanced Function) Flat Resistance Band Bar, Amazon.com product advertisement, Dec. 12, 2019, www.amazon.com, U.S.
(Continued)

*Primary Examiner* — Gary D Urbiel Goldner

(57) ABSTRACT

An exercise device comprising a handlebar structure for securing the ends of a wide, flat, elastic exercise or therapy band quickly, easily, and uniformly to the ends of the handlebar, and further allowing rapid, uniform, balanced adjustments of the band by rolling and unrolling ends of the exercise band around the ends of the handlebar while in use and without change in the user's position.

6 Claims, 7 Drawing Sheets

(56) References Cited

U.S. PATENT DOCUMENTS

| | | | | |
|---|---|---|---|---|
| 4,779,867 | A | 10/1988 | Hinds | |
| 4,836,537 | A * | 6/1989 | Moreno | A63B 21/0004 482/139 |
| 5,125,649 | A | 6/1992 | Fuller | |
| 6,120,424 | A * | 9/2000 | Arline | A63B 21/0004 482/121 |
| 6,402,668 | B1 | 6/2002 | Harker | |
| 7,578,775 | B2 | 8/2009 | Terry | |
| 7,591,763 | B1 * | 9/2009 | Fucci | A63B 21/0552 482/121 |
| 7,846,078 | B1 | 12/2010 | Park | |
| 8,348,814 | B1 | 1/2013 | Hinds et al. | |
| 8,480,549 | B1 * | 7/2013 | Hinds | A63B 7/02 482/143 |
| 9,707,433 | B1 * | 7/2017 | McGibbons | A63B 21/0555 |
| 9,775,764 | B1 * | 10/2017 | Rill | A61H 1/0237 |
| 9,919,176 | B2 * | 3/2018 | Christie | A63B 23/03525 |
| 9,974,993 | B1 * | 5/2018 | Pollock | A63B 23/035 |
| 10,874,896 | B1 * | 12/2020 | Little | A63B 21/0442 |
| 2002/0160891 | A1 * | 10/2002 | Gallagher | A63B 21/154 482/123 |
| 2005/0239617 | A1 | 10/2005 | Tenaglia | |
| 2007/0173387 | A1 * | 7/2007 | Wu | A63B 21/0004 482/121 |
| 2007/0225134 | A1 * | 9/2007 | Slattery | A63B 23/0211 482/140 |
| 2008/0081747 | A1 | 4/2008 | Mok | |
| 2009/0192022 | A1 | 7/2009 | Kulka | |
| 2009/0253557 | A1 | 10/2009 | Klein | |
| 2010/0152002 | A1 | 6/2010 | Knight | |
| 2014/0024508 | A1 * | 1/2014 | Hinds | A63B 21/00043 482/129 |
| 2015/0141216 | A1 * | 5/2015 | Gvoich | A63B 21/00043 482/126 |
| 2016/0074692 | A1 | 3/2016 | Vial | |
| 2016/0236054 | A1 * | 8/2016 | Johnson | A63B 69/004 |
| 2017/0182348 | A1 * | 6/2017 | Bertolutti | A63B 21/0557 |
| 2017/0274239 | A1 | 9/2017 | Barella | |
| 2018/0264304 | A1 * | 9/2018 | Pollock | A63B 21/0557 |
| 2019/0120325 | A1 * | 4/2019 | Bisang | A63B 21/0555 |
| 2020/0094103 | A1 * | 3/2020 | Wallander | A63B 23/12 |
| 2020/0269080 | A1 * | 8/2020 | Jaquish | A63B 21/0428 |

OTHER PUBLICATIONS

The Bodygym Store, Bodygym Core System Portable Home Gym, Amazon.com product advertisement, Mar. 2017 (earliest product review), www.amazon.com, U.S.

Rogue Fitness, Bandbell Bars, internet product advertisement, 2016 (earliest product review), www.roguefitness.com, U.S.

* cited by examiner

EXERCISE BAND BAR

RELATED APPLICATIONS/PRIORITY BENEFIT CLAIM

This application claims the benefit of U.S. Provisional Application No. 62/965,223, filed Jan. 24, 2020 by the same inventor (Clarke), the entirety of which provisional application is hereby incorporated by reference.

FIELD

The subject matter of the present application is in the field of handheld exercise and physical therapy devices using elastic bands.

BACKGROUND

Devices for complementing the use of elastic cords and bands for exercises and physical therapy are known.

One example is shown in U.S. Patent Application Publication No. US2017/0274239 to Barella. Barella shows an exercise bar or tube with slotted ends for inserting the knotted ends of an elastic stretch band. The bar is useful for exercises while holding the bar with two hands and anchoring the band underfoot.

Another example is shown in U.S. Pat. No. 6,402,668 to Harker. Harker shows a rigid bar or tube with slotted ends. Handles attached to the ends of a tubular, cord-like elastic member in a stirrup configuration include portions insertable into the ends of the bar, with portions of the stirrup configuration fed into the corresponding slots. The bar may be rolled to entwine a portion of the elastic member onto the bar, to shorten the length of the elastic member and increase its resistance.

Neither Barella nor Harker allows a flat elastic exercise band to be adjusted relative to the handlebar with good uniformity or consistency, which is critical to the proper and balanced use of such bands for physical therapy exercises. Nor do these prior devices appear to allow an efficient and uniform adjustment of an elastic exercise band attached to a handlebar "on the fly", or while in use. The connections of the prior art bars to their elastic members also appear to place unnecessary localized strain on their respective elastic members, which would result in them wearing out faster.

Further, the prior art connections of the bars to their elastic members require unnecessarily complicated structures or manipulation to attach and detach the elastic members to the bars, making the changing of elastic members for different exercises slower and more cumbersome.

BRIEF SUMMARY

The present invention comprises an exercise band handlebar device in which the ends of a wide, flat, elastic exercise or therapy band can be quickly, easily, and uniformly secured to the ends of the bar, and further which allows rapid, uniform adjustments of the band as to length and resistance while in use.

In a first form, the exercise band handlebar device comprises an elongated handlebar with open tubular ends, each open tubular end having a longitudinal slot through the associated sidewall portion. Each end of a wide, flat exercise band is secured in flat, full-width fashion to a rigid spreader insert rod or tube (hereafter "tube") whose diameter is less than the inner diameter of the open tubular ends of the handlebar. The spreader insert tubes are removably inserted lengthwise into the open tubular ends of the handlebar, with the flat, full-width ends of the exercise band extending through the longitudinal slots.

The inserted spreader insert tubes rest in eccentric fashion against inner sidewall portions of their respective tubular ends of the handlebar, with the friction of the flat ends of the exercise bands extending across the spreader insert tubes securing the spreader insert tubes in place in the tubular ends, especially during exercises when the band is stretched and even more so when the band ends are partially or fully wound one or more times in flat, full-width fashion around the ends of the handlebar.

The friction of the flat, full-width, spread exercise band ends in the slots and on the outer faces of the tubular handlebar ends also allows the band to be rolled up very quickly and very uniformly by the person holding the handlebar, while in use and without any need for adjustment or manipulation of the band or any intervening structure.

In a further form, the connection of the ends of the exercise band to the spreader insert tubes is formed with a full-length stiffening member at each end of the band, for example a rod permanently attached to each end of the band and then inserted into a hollow interior of the spreader insert tube and secured therein in an eccentric manner, with a longitudinal slot in the spreader insert tube accommodating the exercise band.

The exercise band with the spreader insert tubes secured at each end may be used independently of the handlebar, if desired, with the spreader insert tubes providing individual hand grips. Multiple sets of exercise bands equipped with spreader insert tubes secured to their ends may be provided and quickly swapped in and out of the handlebar.

These and other features and advantages of the invention will become apparent from the detailed description below, in light of the accompanying drawings.

DETAILED DESCRIPTION

Figure 1:
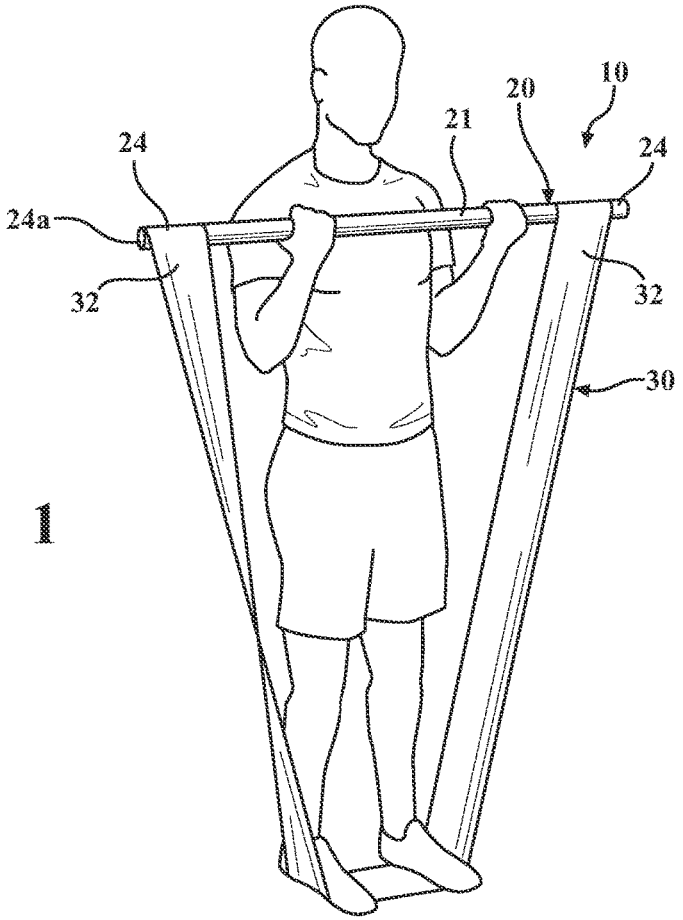
FIG. 1 is a perspective view of a person doing a standing exercise with an exercise band handlebar device according to the invention.

Referring first to FIG. 1, an exercise device 10 according to the invention is shown in exemplary form in order to teach how to make and use the claimed invention. Device 10 comprises a "handlebar" 20 long enough to be securely held with two spaced hands on an intermediate portion 21 between outer ends 24, like a barbell shaft but significantly lighter, in the illustrated example being made from a hollow plastic tube such as PVC, on the order of three feet long. The dimensions and weight and material of the handlebar 20 may vary, depending on the size, ability, and strength of the intended user. The tubing used for handlebar 20 should be sufficiently rigid that it does not significantly bow or bend under the force of exercises applied to the tubular ends through an elastic rubber exercise band 30.

While handlebar 20 is illustrated in the example of FIG. 1 as a continuously hollow cylindrical tube, it should be understood that only the outer ends 24 and their tubular open end passages 24*a* need be tubular and hollow, for a distance at least equal to the width of the exercise bands intended to be used with the handlebar, plus preferably a little farther, e.g. an inch or two. The intermediate body portion 21 of handlebar 20 may be solid, and both the intermediate body portion 21 and the tubular outer ends 24 may have non-cylindrical cross-sections, such as oval or polygonal. It is preferred, however, that the outer ends be substantially cylindrical without overly-aggressive corners or edges, in order to allow the flat ends of band 30 to be smoothly wound around the tubular ends of the handlebar when the handlebar is rotated. In the preferred example currently illustrated, both the outer and inner surfaces of the open tubular ends 24 are cylindrical.

Exercise band 30 is a wide flat elastic band of rubber-like material of known type, and may come in different colors and elastic strengths, as is known in the art. The width and overall length of band 30 may also vary, although a width of approximately 4-6" (inches) is typical along with a length of several feet, trimmed to size per user (and therapist) preference. In use, the ends 32 of the band are capable of being wrapped in flat, even, full-width fashion partially or fully one or more times around the ends 24 of handlebar 20.

Figure 2:
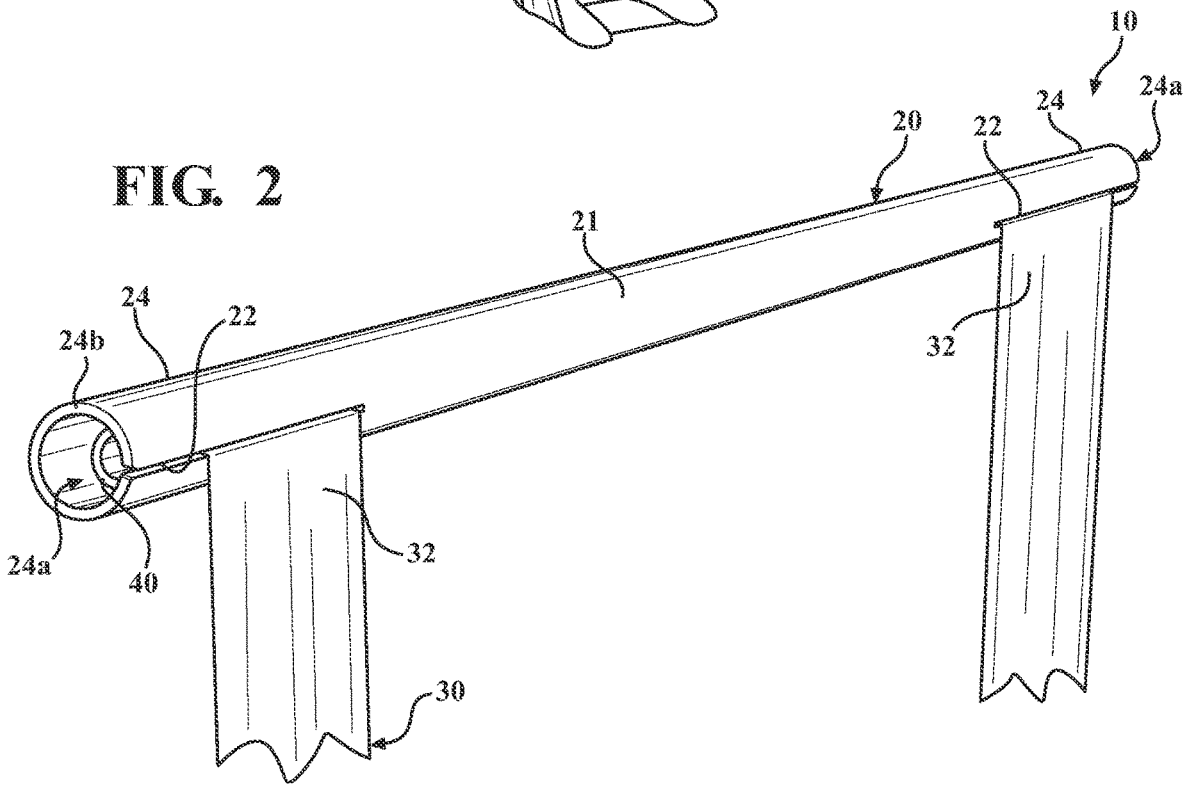
FIG. 2 is a detailed perspective view of the handlebar exercise band device of FIG. 1.
Figure 2A:
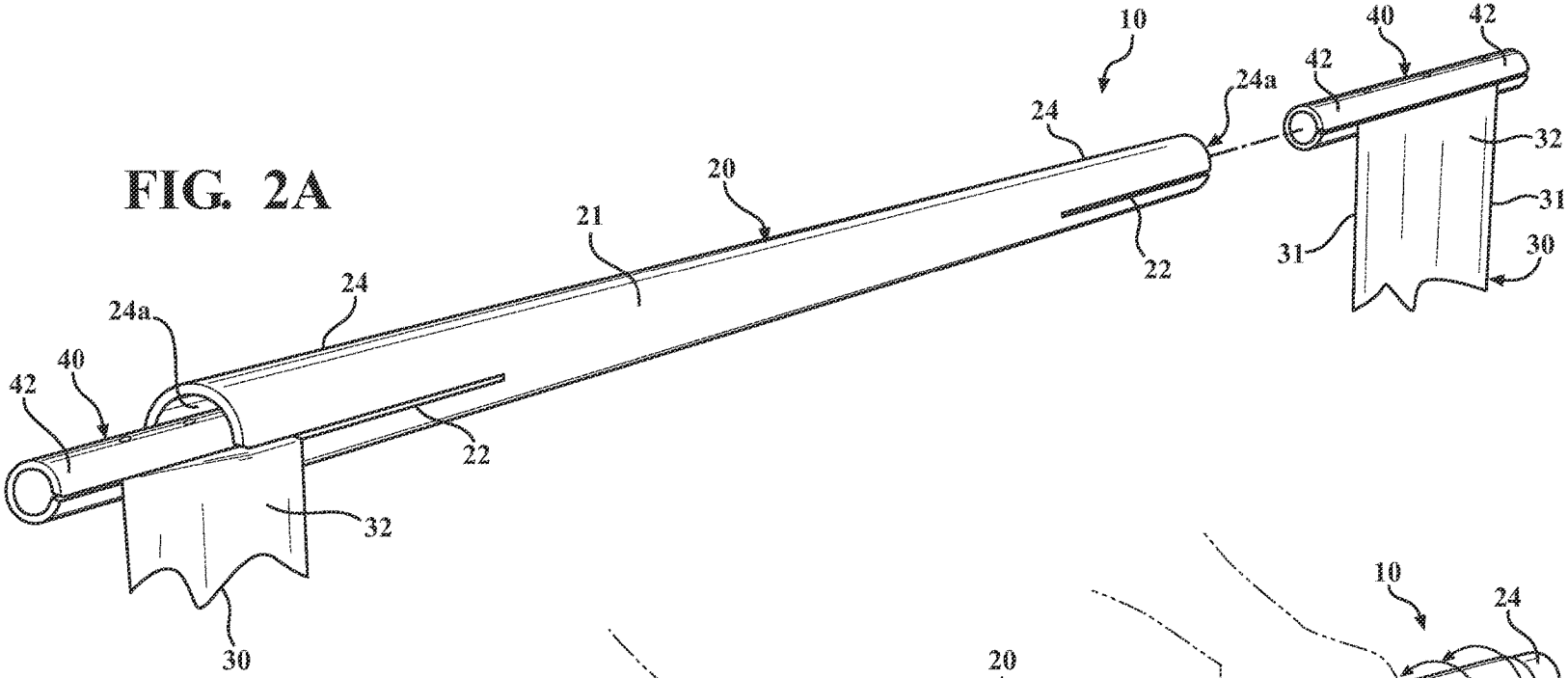
FIG. 2A is similar to FIG. 2, but shows the ends of the exercise band partially and fully exploded from the tubular ends of the handlebar.

Referring to FIGS. 2 and 2A, each end 32 of band 30 extends in flat, full-width fashion from a slot 22 formed through the sidewall 24*b* of handlebar ends 24, the slots extending partway inwardly from open ends 24*a* toward the middle of the handlebar in circumferential alignment with one another a distance equal to or greater than the width of the ends 32 of band 30 and spreader insert tubes associated with the ends of the band. The ends 32 of band 30 are each secured in flat, full-width fashion to a spreader insert "tube" 40 inserted in a respective open end 24*a* of the handlebar 20. In the illustrated example, spreader insert tubes 40 comprise hollow plastic tubes having a length greater than the width of band 30, such that ends 42 of inserts 40 terminate at or slightly past the ends 32 and side edges 31 (FIG. 2A) of band 30, for example for an inch or so. Spreader insert tubes 40 are preferably cylindrical, as shown, of a diameter smaller than the inner diameter of the tubular open ends 24*a* of handlebar 20. Spreader insert tubes 40 may also be solid rods rather than hollow tubes, provided that the ends 32 of the exercise band 30 are securely attached in flat fashion along the full width of the band ends across the respective tubes 40. And while a cylindrical cross-section is preferred for tubes 40, other cross-sections, both rounded and polygonal, are possible, again provided that their diameter or width is less than the inner diameter of the tubular ends 24*a* of the handlebar 20.

Figure 3:
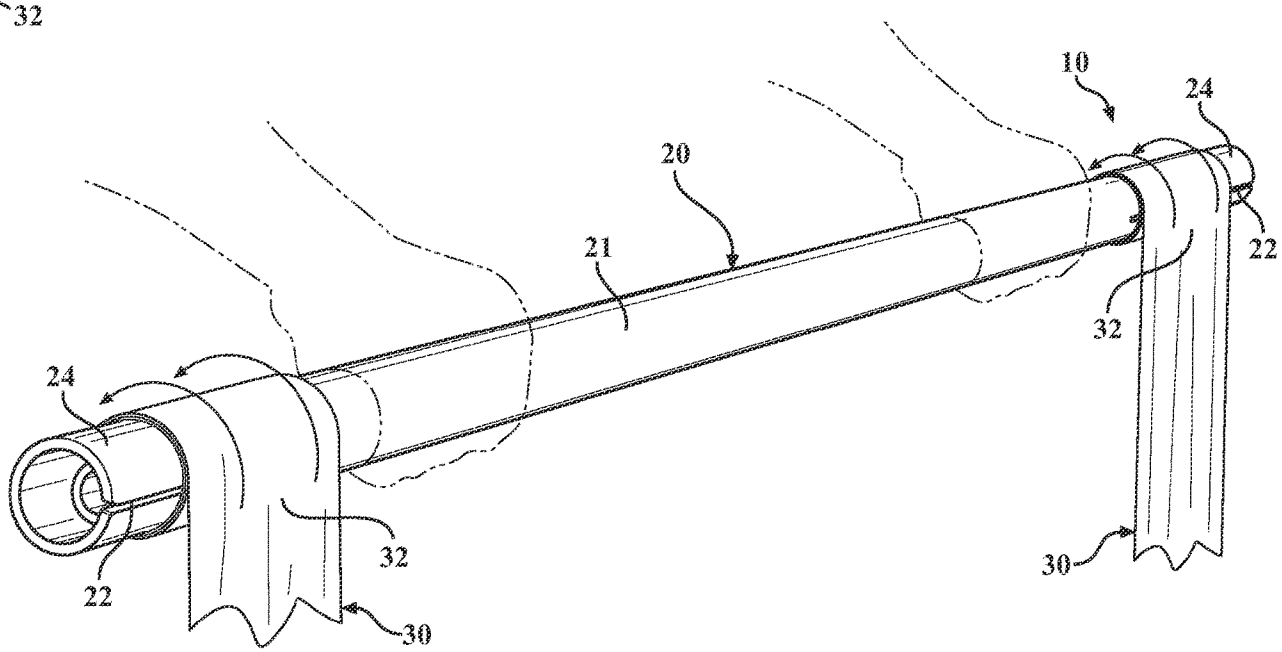
FIG. 3 is similar to FIG. 2, but shows the exercise band partially rolled up around the ends of the handlebar.
Figure 6:
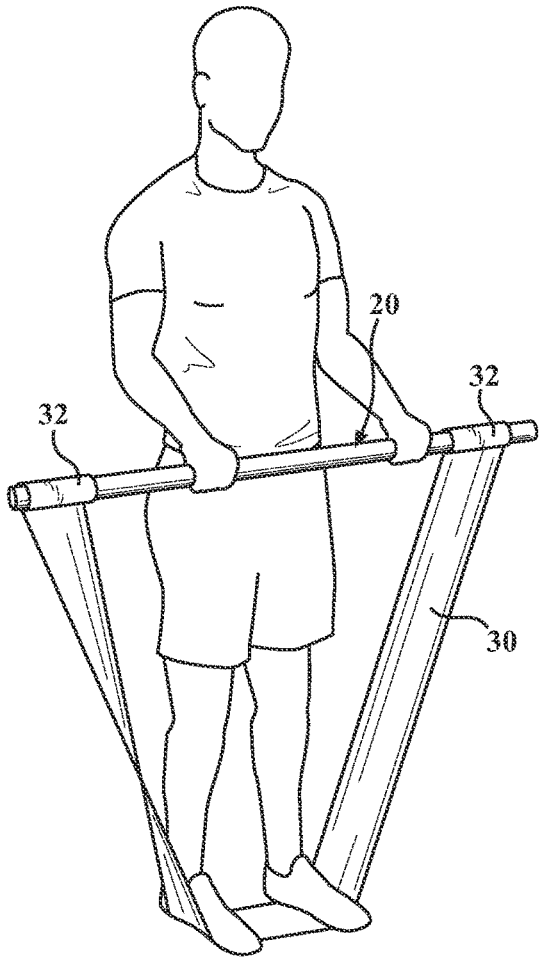
FIG. 6 is similar to FIG. 1, but showing a person doing a standing exercise with the exercise band wound partially around the ends of the handlebar to shorten the band.
Figure 7B:
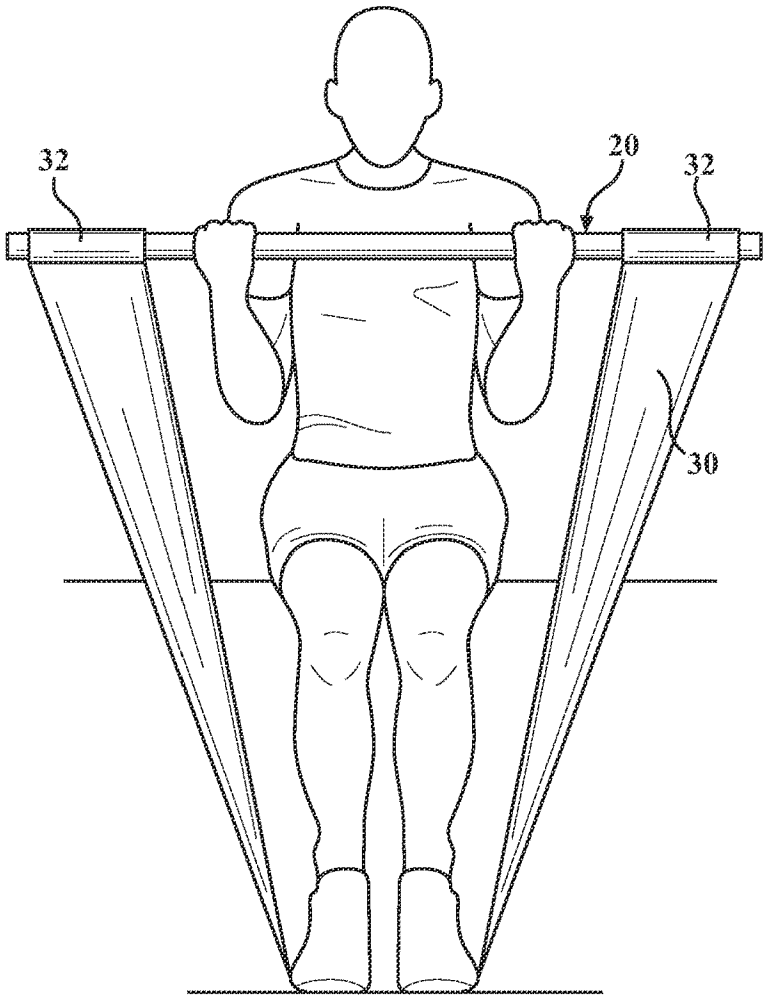
FIGS. 7A, 7B, 7C, and 7D show different seated exercises being performed with the handlebar and exercise band structure of FIG. 1.
Figure 7A:
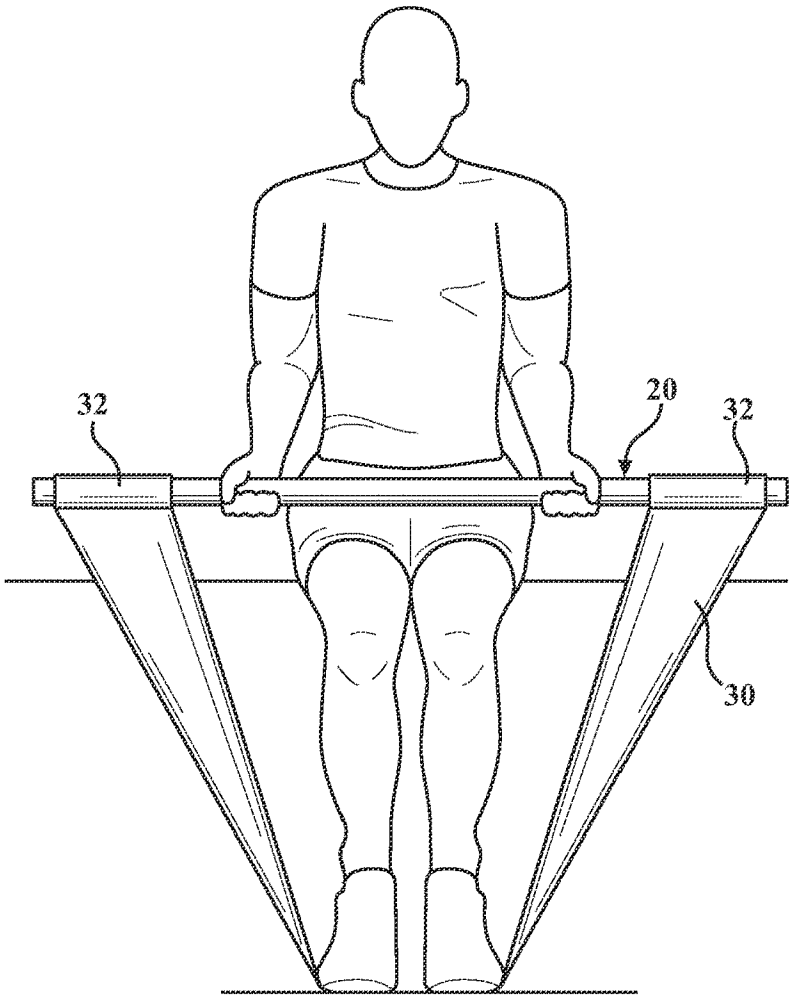
Figure 7D:
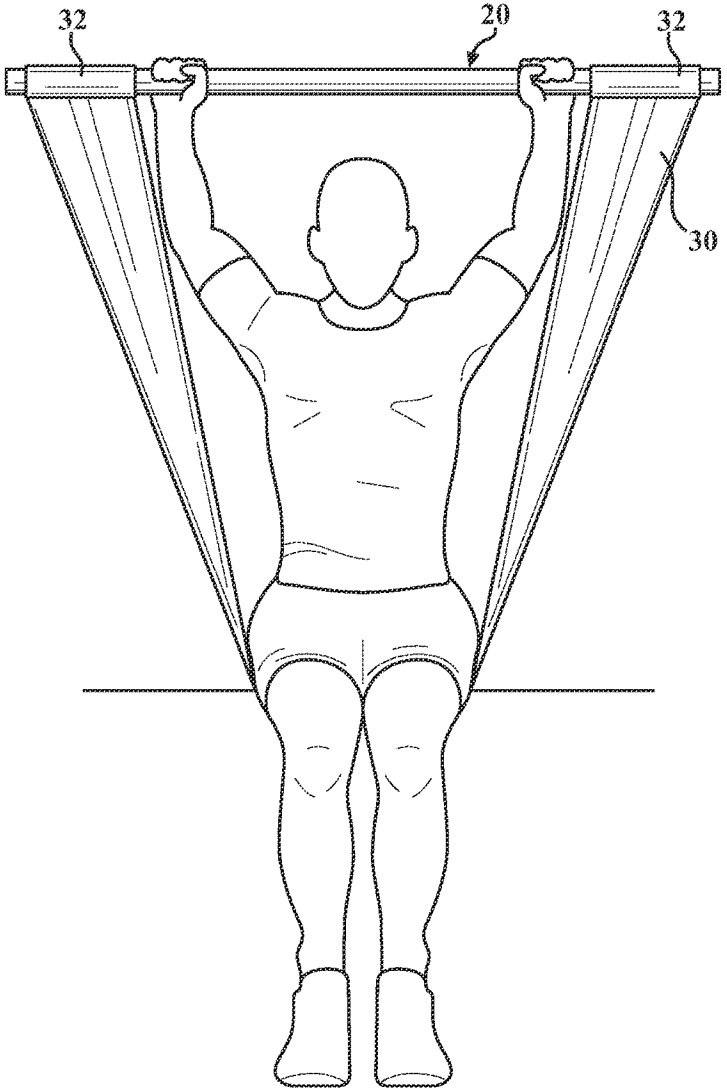
Figure 7C:
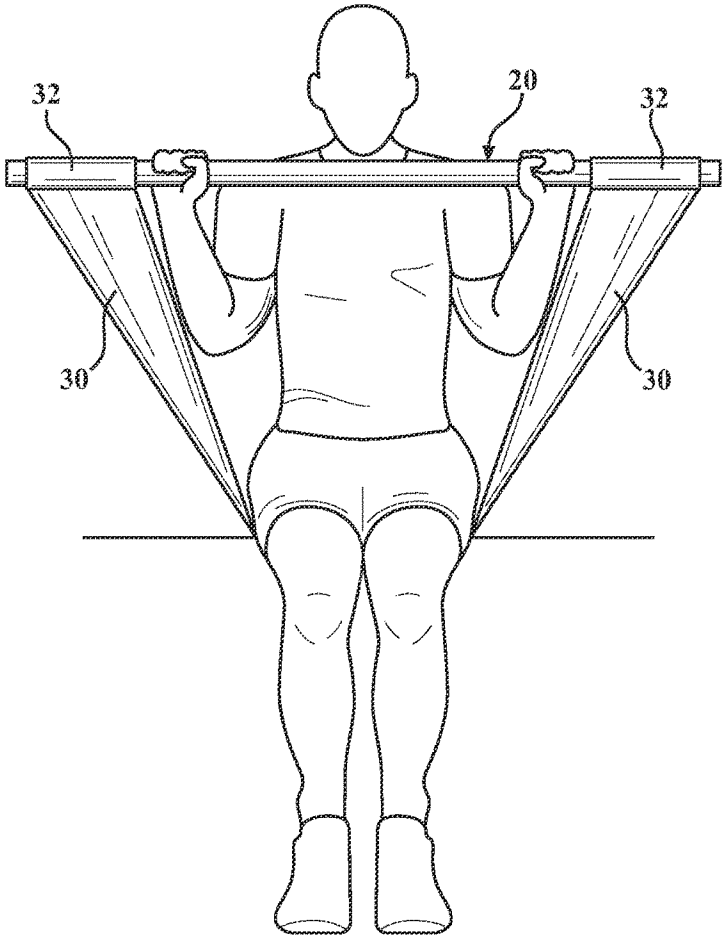
Figure 8:
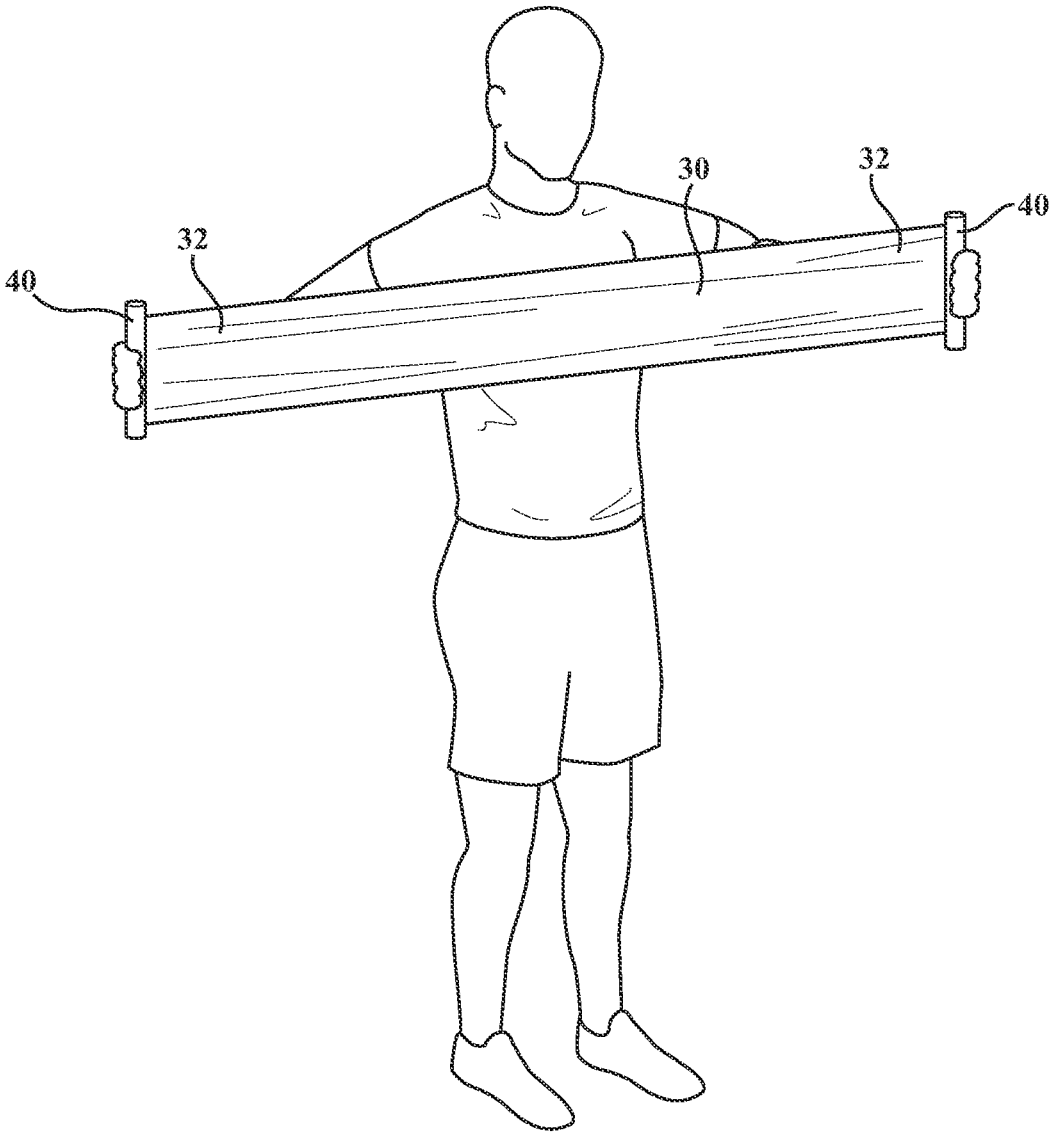
FIG. 8 shows the exercise band structure of FIG. 1 being used by a person independently of the handlebar.

FIG. 3 schematically shows the rolling and unrolling of the ends 32 of band 30 around the ends 24 of the handlebar 20. While grasping the middle or intermediate portion 21 of the handlebar, the user simply rotates the handlebar with his or her hands in the desired direction while band 30 is under enough tension to keep ends 32 flat against the outer ends 24, for example while the band is trapped underfoot as shown in FIGS. 1 and 6. The winding or wrapping of the ends of band 30 in flat, full-width fashion around the ends of the handlebar as shown helps distribute tension evenly across the width of the band, and the variation in the amount of band wound around the ends of the handlebar each time the band is adjusted for a different user or a different exercise ensures that stress is not concentrated on the same sections of the band ends from use to use, preserving the life of the band.

Figure 4:
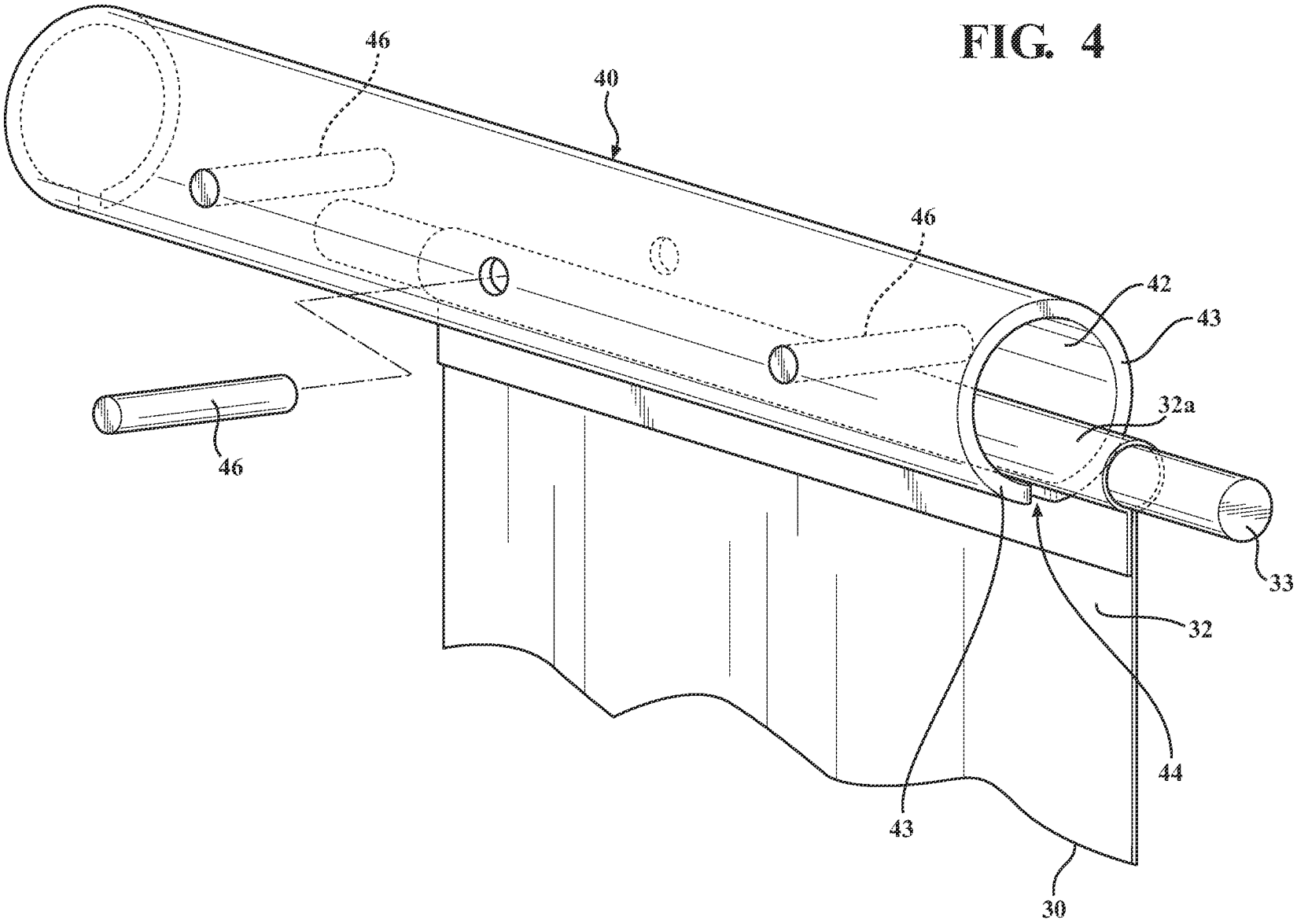
FIG. 4 is an exploded detail view of one of the spreader tube ends of the exercise band of FIG. 2.
Figure 5A:
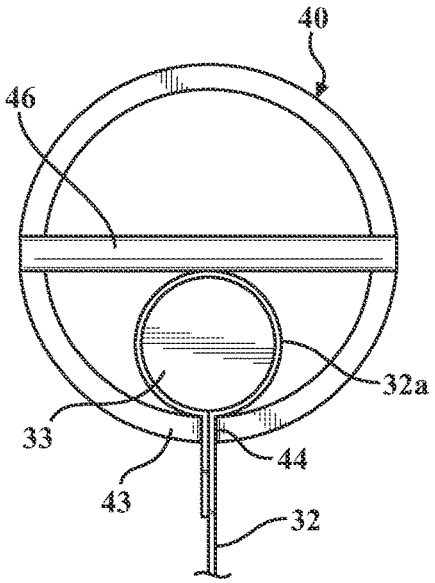
FIG. 5A is an end view of the spreader tube end structure of FIG. 4.
Figure 5B:
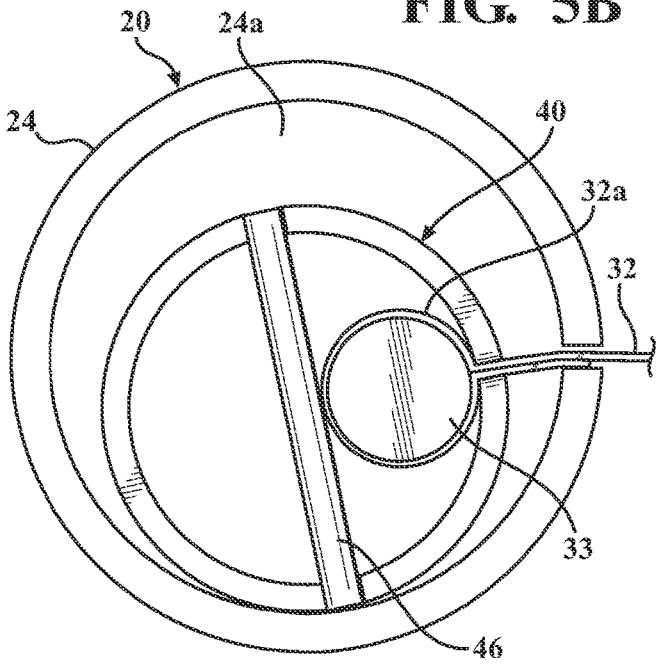
FIG. 5B is an end view of the exercise band handlebar device of FIG. 2.

Referring to FIGS. 4 and 5A-5B, spreader insert tubes 40 in the illustrated, preferred example comprise hollow tubes with at least one open end 42, and are partially or fully split by a lengthwise slot 44 through the tube sidewall 43, the slot running most or all of the length of the tube. The innermost or terminal end 32*a* of the exercise band 30 is stiffened across its width, for example with a stiffener such as a rod or dowel 33 glued, molded, or mechanically attached to the end 32*a* of the band 30. The stiffened end 32*a* of the exercise band is inserted into the hollow interior of the spreader insert tube, with the exercise band ends 32 extending out through slot 44. The diameter or width of the stiffener 33 and the stiffened end 32*a* of band 30 is less than the interior diameter of spreader insert tube 40, such that the stiffened end 32*a* can be secured against an inside wall of the spreader insert tube off-center or eccentrically from the longitudinal axis of tube 40. This off-center position can be secured with various fastening mechanisms, in the illustrated example with a plurality of radial through-bolts or spacers 46 extending through tube 40 to clamp stiffened end 32*a* of the exercise band against the inner sidewall of tube 40 against slot 44, and/or by squeezing or pulling the ends of sidewall 43 of tube 40 that border slot 44 against the portion of exercise band 30 extending through the slot. Other structures and techniques for securing the stiffened end 32*a* of exercise band 30 inside the spreader insert tube 40 would be possible and could be used, but the illustrated structure is a currently preferred example.

With the innermost ends 32*a* of the exercise band 30 essentially permanently secured in spreader insert tubes 40, spreader insert tubes 40 can be quickly and easily inserted into the open tubular ends 24*a* of handlebar 20 with the respective ends 32 of the exercise band 30 extending in flat, full-width fashion from the corresponding-length slots 22, as best shown in FIG. 5B. Slots 22 are preferably circumferentially aligned, as shown, so that the exercise band 30 extends evenly from the ends 24 of handlebar 20.

No additional structure is needed to keep spreader insert tubes 40 and the ends 32 of the exercise band 30 securely attached to handlebar 20 for normal handling and exercise, as the friction of the flat, full-width, spread exercise band ends 32 against the edges of the slots 22 and on and around the outer surfaces of the handlebar 20 at ends 24 is sufficient to hold the spreader insert tubes 40 in place without longitudinal slippage. This effect is increased by the off-center bias location of the smaller diameter spreader insert tubes 40 relative to the axis of the tubular ends of the handlebar, as the spreader tubes 40 rest against or are tensioned against the nearest inner sidewall surface of the handlebar ends 24. Yet, when it is desired to remove a first exercise band 30 from handlebar 20 for storage, travel, or to replace it with a band of different resistance, spreader tubes 40 and the ends 32 of band 30 in their relaxed, untensioned state, with the band ends 32 unwound from around the ends of the handlebar and relaxed or un-stretched, are easily slid out of the ends 24*a* of the handlebar.

Handlebar 20 is illustrated as a unitary tube, but it will be understood that handlebar 20 could be manufactured in joinable sections that can be assembled for exercise and disassembled for storage or travel. Also, handlebar 20 may be provided in a fixed length, and the tubular ends 24 then shortened by cutting or sawing in order to customize the overall length of the handlebar 20. Further, tubular ends 24 could be supplied as separate pieces, joinable to the ends of the intermediate portion 21 of handlebar 20 by sliding or telescoping them over the handlebar with a close fit and then securing them at a desired position with mechanical fasteners or connections and/or adhesive to customize the overall length of the handlebar.

Description of Operation

In operation, the exercise device 10 illustrated above can be used for many different exercises, some of which are shown in FIG. 1, FIG. 6, and FIGS. 7A-7D. By anchoring some portion of the exercise band 30 to a support or against a firm surface, including but not limited to being held to the floor underfoot, being sat upon, or being hooked to a doorknob or piece of furniture, the number of exercises capable of being performed is nearly limitless.

More importantly, the nature of the connection of the ends 32 of exercise band 30 to the ends 24 of handlebar 20, with a full-width, flat presentation from the off-center position inside the tubular ends 24*a* of the handlebar out through the slots 22, allows a very fast, very uniform, very balanced rolling and unrolling of the protruding ends 32 of the exercise band 30 onto and off the outer surface of the ends 24 of the handlebar, while the handlebar is being held in both hands by the user. This is possible even during an exercise routine when it might be difficult for the user to change position or engagement with the handlebar and exercise band, especially if limited in motion due to a physical injury that is being treated by the exercise. Further, by being rolled in flat, full-width fashion at least partially and preferably one or more times around the outer ends 24 of the handlebar relative to the point where they exit the slots in handlebar ends 24, the ends 32 of the band 30 are evenly tensioned during use, and are rarely stressed at the same point from user to user or from exercise to exercise. Also, a single length of band 30 can be quickly adapted not only to multiple exercises but to multiple users of different height or strength by simply rolling or unrolling the ends 32 of the band 30 from handlebar ends 24 a different amount via a desired number of revolutions or partial revolutions of the handlebar.

It will finally be understood that the disclosed embodiments represent presently preferred examples of how to make and use the invention, but are intended to enable rather than limit the invention. Variations and modifications of the illustrated examples in the foregoing written specification and drawings may be possible without departing from the scope of the invention. It should further be understood that to the extent the term "invention" is used in the written specification, it is not to be construed as a limiting term as to number of claimed or disclosed inventions or discoveries or the scope of any such invention or discovery, but as a term which has long been used to describe new and useful improvements in science and the useful arts. The scope of the invention supported by the above disclosure should accordingly be construed within the scope of what it teaches and suggests to those skilled in the art, and within the scope of any claims that the above disclosure supports in this application or in any other application claiming priority to this application.

The invention claimed is:

1. An exercise device allowing for rapid, uniform adjustments of an exercise band as to length and resistance while in use, the exercise device comprising:

a handlebar being elongated and comprising two open tubular ends, each open tubular end having an inner diameter and including a longitudinal slot of a first width through an associated sidewall portion;

the exercise band being wide, flat, and elastic, and comprising two flat, full-width ends, each flat, full-width end having a second width less than or equal to the first widths of the longitudinal slots, respectively, each flat, full-width end secured in flat, full-width fashion to one of a pair of spreader insert tubes being separate and rigid, each spreader insert tube having a length equal to or greater than the second widths of the two flat, full-width ends of the exercise band, respectively, and each spreader insert tube further having a diameter less than the inner diameters of the two open tubular ends of the handlebar, respectively;

wherein each spreader insert tube is removably inserted lengthwise into a respective one of the two open tubular ends of the handlebar, with the two flat, full-width ends of the exercise band respectively extending through the longitudinal slots in the flat, full-width fashion, and further with the pair of spreader insert tubes respectively resting off-center in the two open tubular ends against a corresponding inner surface of the associated sidewall portion; and wherein the handlebar is configured for respectively securing the two flat, full-width ends of the exercise band quickly, easily, and uniformly to the two open tubular ends of the handlebar.

2. The exercise device of claim 1, wherein the pair of spreader insert tubes comprise hollow interiors and substantially full-length slots through sidewalls thereof, and wherein each flat, full-width end of the exercise band further comprises a full-width stiffened portion secured inside a respective one of the hollow interiors of the spreader insert tubes, with non-stiffened portions of the two flat, full-width ends of the exercise band respectively extending through the substantially full-length slots through the sidewalls of the pair of spreader insert tubes in the flat, full-width fashion.

3. The exercise device of claim 2, wherein the full-width stiffened portions of the two flat, full-width ends of the exercise band are respectively secured off-center in the hollow interiors of the pair of spreader insert tubes.

4. The exercise device of claim 1, wherein outer surfaces of the two open tubular ends are substantially cylindrical.

5. The exercise device of claim 1, wherein the inner surfaces of the two open tubular ends are substantially cylindrical.

6. The exercise device of claim 1, wherein the longitudinal slots in the two open tubular ends are respectively and circumferentially aligned with one another.

* * * * *